US006321948B1

(12) United States Patent
Bellon et al.

(10) Patent No.: US 6,321,948 B1
(45) Date of Patent: Nov. 27, 2001

(54) TAP AND VALVE ASSEMBLY

(75) Inventors: Tiziano Bellon, Ft. Wayne; Jeffrey Beaver, Indianapolis; Tom Kasting, Ft. Wayne, all of IN (US)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 09/542,572

(22) Filed: Apr. 4, 2000

(51) Int. Cl.[7] ..... B67D 3/00
(52) U.S. Cl. ..... 222/153.14; 222/553; 222/555
(58) Field of Search ..... 222/153.06, 153.14, 222/548, 553, 555

(56) References Cited

U.S. PATENT DOCUMENTS

| | | | | |
|---|---|---|---|---|
| 4,493,438 | * | 1/1985 | Rutter | 222/553 |
| 4,579,141 | | 4/1986 | Arff | 137/223 |
| 4,605,342 | * | 8/1986 | Legille et al. | 222/548 |
| 4,946,079 | * | 8/1990 | Campbell | 222/548 |
| 5,097,991 | | 3/1992 | Lance | 222/442 |
| 5,720,417 | | 2/1998 | Wurth et al. | 222/146.5 |
| 5,730,359 | | 3/1998 | Wurth | 239/66 |
| 6,170,710 | * | 1/2001 | Suffa | 222/153.06 |

FOREIGN PATENT DOCUMENTS

| | | | | |
|---|---|---|---|---|
| 2181419 | * | 4/1987 | (GB) | 222/153.06 |
| 2210030 | * | 6/1989 | (GB) | 222/548 |

* cited by examiner

*Primary Examiner*—Joseph A. Kaufman
(74) *Attorney, Agent, or Firm*—Kwadjo Adusei-Poku; Lloyd D. Doigan

(57) ABSTRACT

A tap and valve assembly for selectively storing or dispensing fluid from a fluid container, comprising a tap body which attaches to the fluid container, a tap handle that inserts within the tap body and provides a structure for opening and closing the fluid passageway from the fluid container through the tap assembly, a valve housing having a tapered nose section, and a valve mechanism housed within the valve housing. As the tap body is inserted within the valve housing, the valve mechanism is opened creating a fluid passageway through the valve housing. A locking tab for securing the tap assembly in the closed position must be broken off before the tap may be rotated to the on position. A key mechanism ensures the assembly of matched tap and valve assemblies.

22 Claims, 7 Drawing Sheets

TAP AND VALVE ASSEMBLY

I. FIELD OF THE INVENTION

This invention relates to a tap and valve assembly used to dispense fluids from a container to a receptacle, hose or dispensing system. The tap assembly can be used with the valve assembly in a closed system, or independently as a stand-alone dispensing tap.

II. BACKGROUND OF THE INVENTION AND DESCRIPTION OF THE PRIOR ART

Tap and valve assemblies have been used within the industry for dispensing fluid from a container to a receptacle or other fluid-receiving device. The typical tap assembly comprises an attachment receptacle for attaching the tap assembly to the fluid container and a tap handle for opening and closing the fluid passageway through the tap assembly. A valve assembly is most often combined with the tap assembly when the fluid is conveyed through a hose, tube or other dispensing or pumping system.

Prior art tap dispensing systems have as one of their primary disadvantages a propensity to vibrate open during transportation. Another disadvantage of the prior art systems is the possibility of mating a tap assembly attached to a fluid container of a first liquid to a valve assembly attached to a fluid receptacle or dispenser containing a second, incompatible liquid. Both of these and other disadvantages are addressed by the instant invention.

III. SUMMARY OF THE PRESENT INVENTION

The present invention is envisioned for use in the food service, beverage, and/or chemical industries where fluid containers are stored and then transported to a final destination where the fluid is dispensed from the container. A typical fluid container may be the "bag in a box" packaging container. However, any other fluid container may be used. The "bag in a box" packaging container comprises a collapsible plastic bag filled with a liquid that is contained in a cardboard box. The tap is assembled to the bag at the filler and shipped attached to the bag to the end user. The operator can either dispense the liquid directly from the container or connect it to another dispensing system using the valve designed to go with the tap.

The tap assembly comprises a tap body and a tap handle. The tap body comprises a mouth portion for attaching the tap body to the fluid container and a substantially cylindrical shaft, the shaft being oriented perpendicular to the mouth portion. The shaft contains an orifice to create a fluid passageway from the fluid container through the tap body.

The tap handle is placed within the tap body and comprises a knob and a tap stem. The tap stem is also substantially cylindrical and fits sealingly within the tap shaft. The tap stem contains an orifice through its cylindrical wall surface. When the tap knob is rotated to the open position, the orifice in the tap stem is fully aligned with the orifice in the tap shaft. As the tap knob is rotated to the fully closed position, the cylindrical wall of the tap stem serves to completely seal off the orifice in the tap shaft and close the fluid passageway from the fluid container.

In order to prevent the inadvertent or accidental opening of the tap handle during transportation, the invention incorporates a locking or anti-rotation tab attached directly to or integrally molded with the tap handle. This locking tab also serves as a tamper-evident device to visibly indicate whether or not the tap has been opened prior to its intended use. The locking tab comprises a detachable element secured between the tap handle and tap body. The tap handle is prevented from rotating until the locking tab is removed. The locking tab may not be reattached to the tap handle and tap body.

A safety key system is used to secure the connection between the tap and valve and to insure that the correct valve is connected to the tap. The tap and valve assemblies are used together when it is necessary to transfer the contents of the container to another dispensing device, pump, or a remote location. It is important to ensure that the correct valve assembly is connected to its corresponding tap assembly, particularly when combining certain chemicals can have severe and possibly explosive reactions. The safety key extends downwards from the crown of the tap handle and engages a set of parallel ribs located on the valve assembly. The width of each rib, and the spacing between the ribs serves to mate a valve assembly with the corresponding tap assembly, thus preventing the tap from being connected to the wrong valve assembly.

The valve assembly comprises a valve housing with a tapered dispensing end, a piston, a check valve and a coil spring. The piston is sized to sealingly fit within the valve housing. The check valve having a head and a cruciform body is placed through the center of the piston and the coil spring. The head of the check valve seats within the aperture in the piston. The base of the check valve is secured within the valve housing. The spring is anchored between the piston and the valve housing, holding the piston against the head of the check valve.

As the tap assembly is inserted within the valve housing, the tap assembly forces the piston downward against the spring, and unseats the check valve, thereby creating a fluid passageway around the check valve and through the valve housing. When the tap assembly is disconnected from the valve assembly, the spring forces the piston upward to seat the piston against the check valve head portion. This effectively prevents residual fluid remaining in the hose or dispensing apparatus from flowing out of through the detached valve assembly.

Other objects, features and advantages of the invention will be apparent from the detailed description taken in connection with the accompanying drawings.

IV. BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

V. DETAILED DESCRIPTION OF A PREFERRED EMBODIMENT OF THE PRESENT INVENTION

Figure 1:
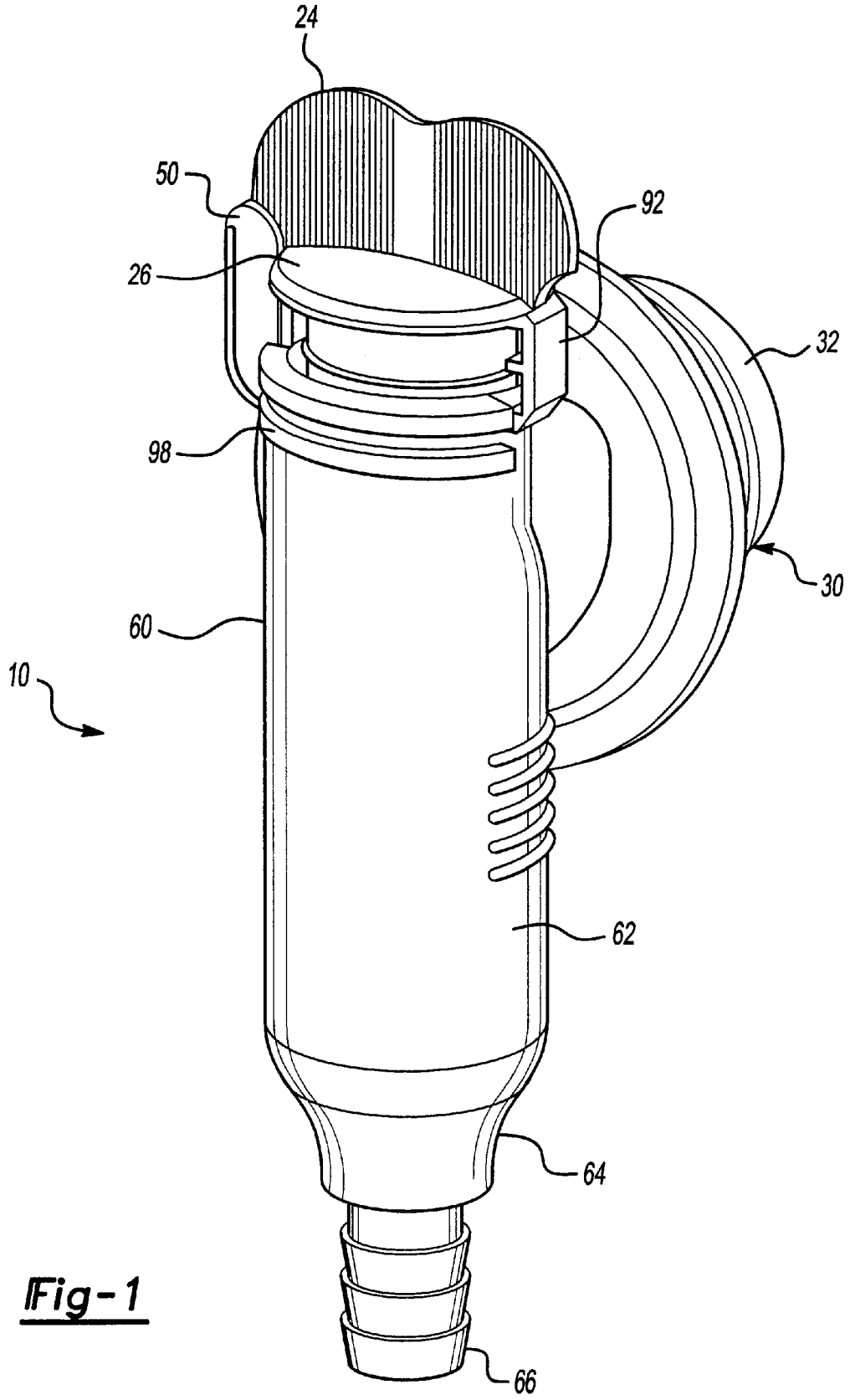
FIG. 1 is a perspective view of the tap and valve assembly according to the invention.
Figure 2:
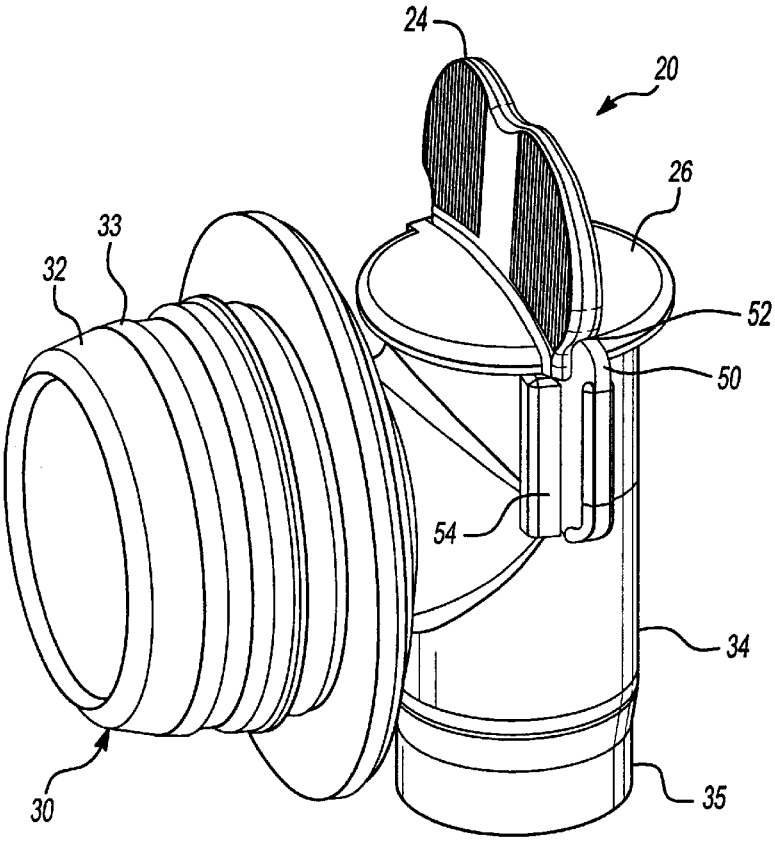
FIG. 2 is a perspective view of the tap assembly.
Figure 3:
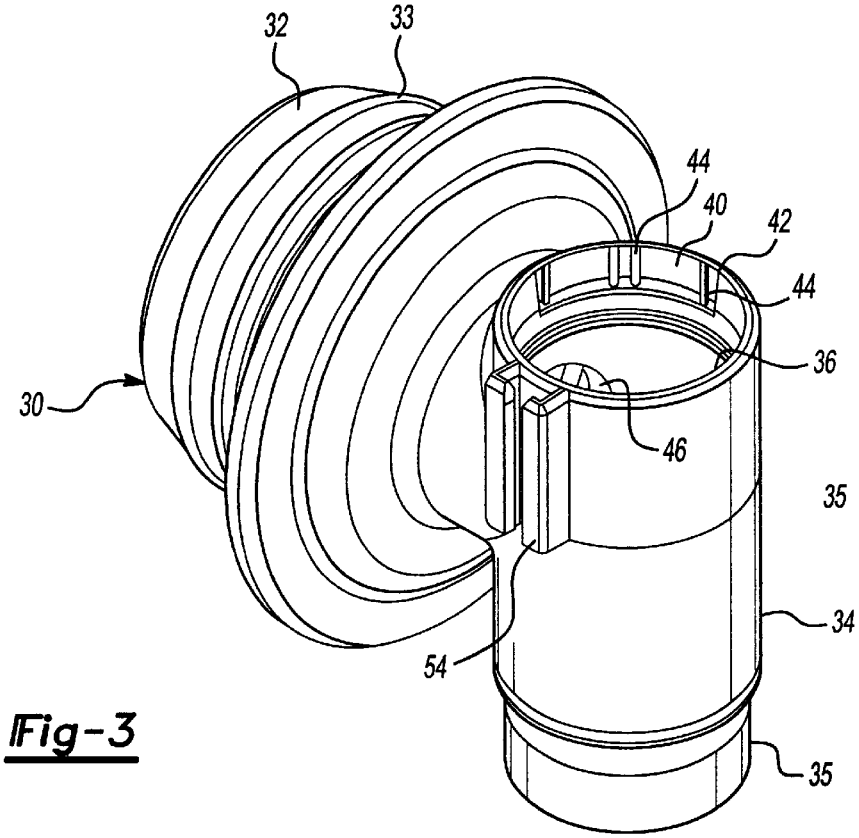
FIG. 3 is a perspective view of the tap body, with the tap handle removed.

FIG. 1 illustrates a tap and valve assembly 10 for dispensing fluid from a fluid container (not shown) to a receiving reservoir (also not shown). Referring to FIGS. 2–7, the tap assembly 20 comprises a tap handle 22 inserted within a tap body 30. As shown in FIG. 3, the tap body 30 comprises a substantially cylindrical receiving mouth portion 32 joined at right angles to a tap shaft 34. The receiving mouth portion 32 is adapted to attach securely to the fluid container. The secure attachment may be of any suitable means, for example, the mouth portion 32 may be threadedly attached to the fluid container, or snap-fitted onto the fluid container. In the preferred embodiment, annular ridges 33 surround the outer surface of the mouth portion 32 to create an interference fit with the neck of the fluid container.

The tap shaft 34, having an upper receiving end and a lower dispensing end 35, is primarily cylindrical and extends downwards beyond the lower surface of the mouth portion 32. The lower dispensing end 35 of the tap shaft 34 is slightly tapered for easy insertion within the valve assembly 60. As best shown in FIG. 3, a grooved track 40, extending downward from the upper surface of the receiving end of the tap shaft 34, is formed along the inner surface of the tap shaft 34. The grooved track 40 is bracketed on either side by the wall of the shaft 34, forming shoulder stops 42. A plurality of ridges 44 is placed within the grooved track 40, one ridge 44 adjacent to each shoulder stops 42, and at desired intervals along the grooved track 40. These ridges 44 provide an intermediate stop to give the operator a tactile indication of the position of the tap handle 22.

A substantially circular orifice 46 is located at the interface between the mouth portion 32 and the tap shaft 34. This orifice 46 provides fluid access from the mouth portion 32 to the tap shaft 34.

Figure 4:
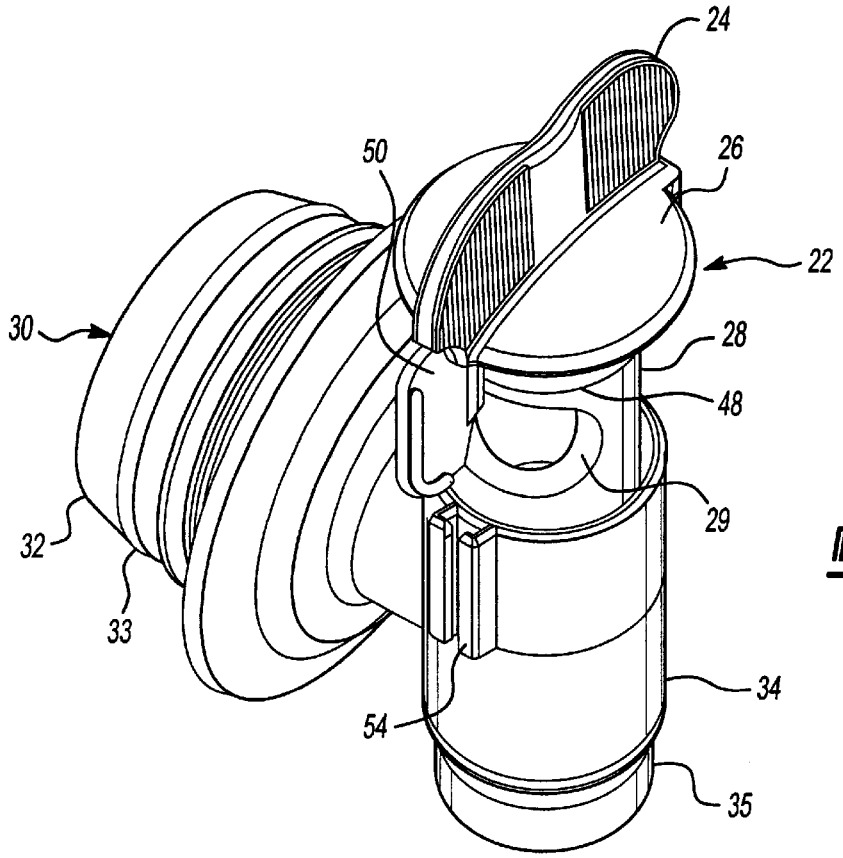
FIG. 4 is a perspective view of the tap handle as it is inserted into the tap body.

Referring primarily to FIG. 4, the tap handle 22 comprises a knurled knob 24 on top of a crown 26, and a cylindrical tap stem 28 that extends downwards, from the crown 26. The tap stem 28 contains an orifice 29 within the downwardly extending cylindrical wall. The tap stem 28 is sized to fit securely and snugly within the tap shaft 34 of the tap body 30. In order to ensure a pressure fit between the tap body 30 and the tap stem 28, an annular sealing bead 48 is located around the outer surface of the tap stem 28 at a location above the orifice 29. A corresponding annular groove 36 is located at a corresponding location along the inner wall of the tap shaft 34. When the tap stem 28 is fully inserted within the tap shaft 34, the sealing bead 48 seats within the annular groove 36 to provide a pressure fit and to eliminate potential fluid back-flow problems when the tap assembly 20 is in use.

The tap stem 28 further comprises a vertical rib (not shown) extending downward from the crown 26. When the tap stem 28 is seated within the tap body 30, the rib rides within the grooved track 40 of the tap body 30, between a first fully open position, and a second fully closed position. The fully open position corresponds to the complete alignment between the orifice 46 in the tap shaft 34 and the orifice 29 in the tap stem 28. As the tap handle 22 is rotated within the grooved track 40 to the fully closed position, the orifice in the tap shaft 34 is completely closed by the cylindrical wall of the tap stem 28. By design, the shoulder stops 42 within the inner wall surface of the tap shaft 34 limit the rotational movement of the tap handle 22. Further, as the vertical rib passes over the ridges 44 at either end of and along the grooved track 40, the operator receives an additional tactile indication that the tap is in the fully closed position, the fully open position, or some other predetermined intermediate position. This tactile indication further prevents the operator from over rotating the knob 24 and damaging the tap assembly 20. It should be appreciated that additional ridges 44 may be used within the arc of the grooved track 40 to indicate various intermediate tap positions.

It is envisioned that the tap assembly 20 will be attached to the fluid container, as the container is either being stored or being transported to its intended place of use. The receiving mouth portion 32 of the tap body 30 is secured to the container with the tap handle 22 in the fully closed position. As discussed above, any securing means may be used, for example a snap-on configuration or a threaded attachment may be employed.

Figure 5:
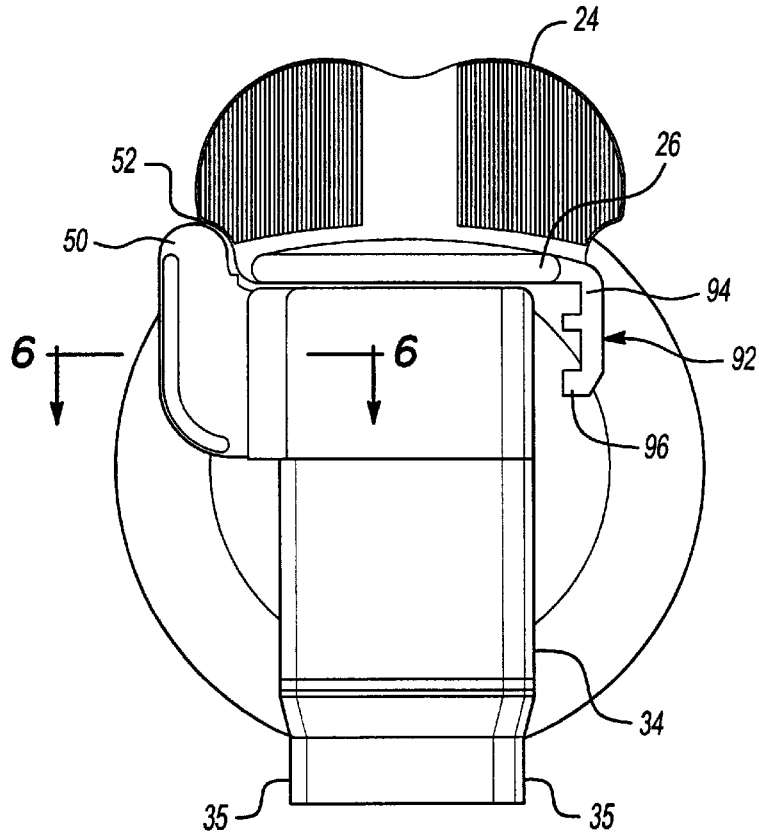
FIG. 5 is an elevational view of the tap body and tap handle, illustrating the key lock and tamper-evident tab features.
Figure 6:
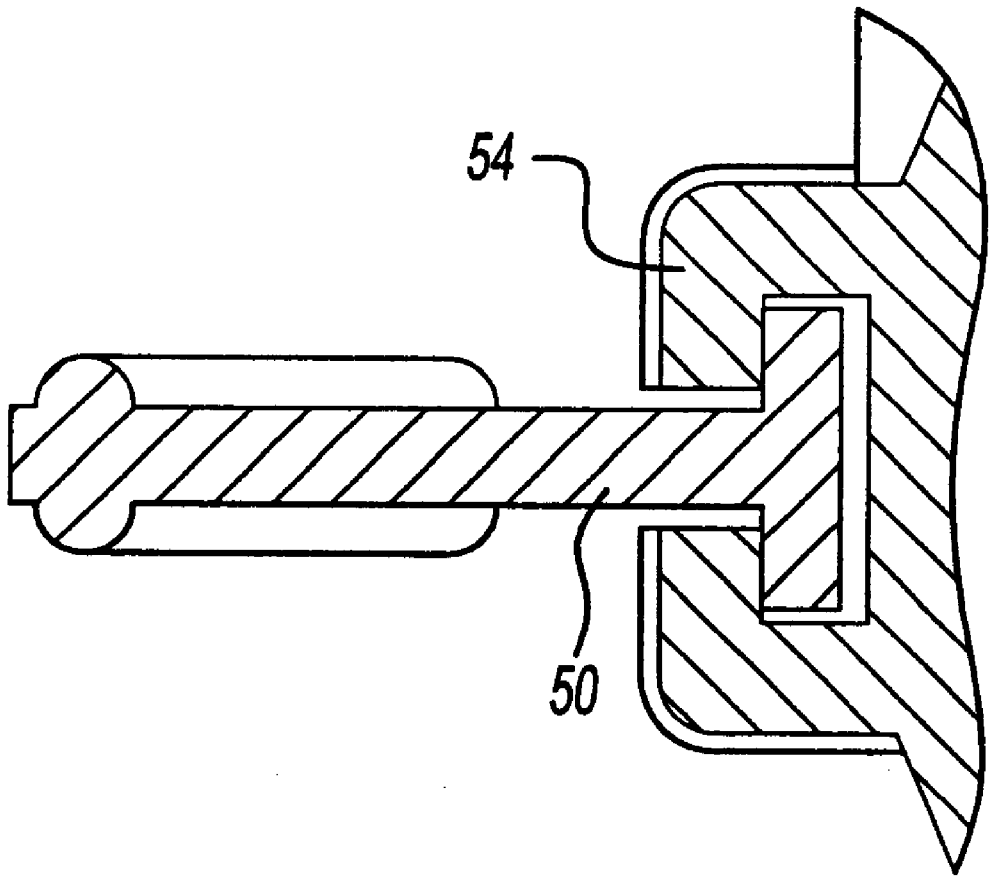
FIG. 6 is a cross-sectional view taken across the section 6—6 of FIG. 5, and showing the locking tab as inserted within the receiving bracket.

Of primary concern to the industry is the inadvertent opening of the tap handle 22 while the fluid container is in transit. To overcome this concern, this invention provides for an integral tap handle locking tab 56 that is connected to the tap handle 22 by a plurality of frangible bridges 52. Referring to FIGS. 4–6, the locking tab 50 extends downwards from the knob 24 of the tap handle 22. Two L-shaped brackets 54 are located on the outer surface of the tap shaft 34 and extend downwards from the rim of the tap shaft 34. These brackets 54 form a channel for receiving the locking tab 50. When the tap handle 22 is inserted within the tap shaft 34, the locking tab 50 is received securely between the brackets 54, locking the tap handle 22 in place and preventing the knob 24 from being rotated. The locking tab 50 and corresponding brackets 54 are positioned so that the tap assembly 20 is in the fully closed position when first assembled.

In order to open the tap assembly 20 by rotating the knob 24, the frangible bridges 52 connecting the locking tab 50 to the knob 24 must be broken. This provides the operator with a visual indication that an attempt has been made to open the tap assembly 20. Hence, the locking tab 50 serves as a tamper-evidence device as well as a lock to ensure that the tap remains closed until its intended use.

Figure 7:
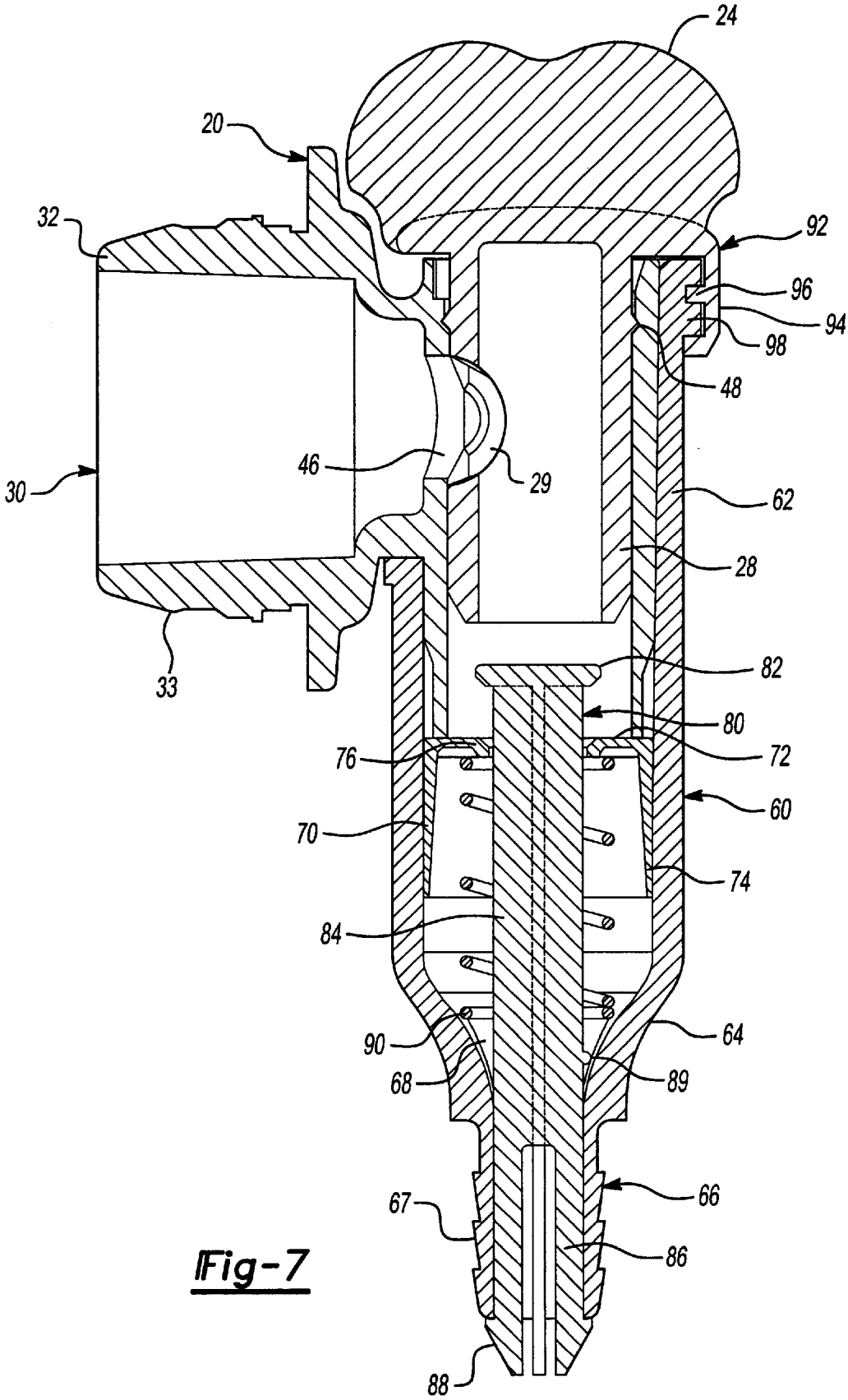
FIG. 7 is a cross-sectional view of the tap and valve assembly in combination with each other.

As shown in FIG. 7, the tap assembly 20 is inserted within a corresponding valve assembly 60. A safety key configuration 92 (described in detail below) is used, in part, to secure together the tap assembly 20 and the valve assembly 60.

The valve assembly 60 comprises a valve housing 62, a valve piston 70 and a check valve 80. The valve housing 62 is primarily cylindrical. A deep "U" shaped cutout is placed in the wall of the valve housing 62 for receiving the tap assembly 20. The lower end of the valve housing 62 is tapered to fit within a receiving tube, hose or other receptacle. In a preferred embodiment, the tapered end of the valve housing 62 has an inwardly curved section 64 and a straight nozzle portion 66 of smaller diameter than the body portion of the valve housing 62. The outer surface of the nozzle portion 66 is adapted with a series of saw teeth 67 for secure attachment with a hose.

As shown in FIG. 7, a piston 70, a check valve 80, and a coil spring 90 are supported within the valve housing 62.

The piston 70 comprises a top surface 72 and a cylindrical skirt portion 74 extending downwards from the top surface 72. The piston 70 is sized to fit sealingly within the valve housing 62, such that liquid may not pass around the top surface 72 of the piston 70. A frustro-conical aperture is positioned in the center of the top surface 72 of the piston 70 for receiving a check valve 80, thus forming a valve seat 76.

The check valve 80 is inserted through the valve seat 76 within the center of the piston 70 and through the center of the coils of the spring 90. The check valve 80 comprises a head portion 82, a body portion 84 extending downwards from the check valve head portion 82, and a plurality of cantilever legs 86 extending downwards from the body portion. The check valve head 82 is sized so as to seat sealingly within the valve seat 76 in the center of the piston 70. In the preferred embodiment, the body portion 84 is in the shape of a cruciform. The cantilever legs 86 culminate in barbs 88 that protrude upwards and outwards. A retaining node 89 is located along an outer projection of the check valve body portion 84. The distance between the retaining node 89 and the barbs 88 at the tips of the cantilever legs 86 is set so as to limit vertical movement of the check valve 80 within the valve housing 62.

When the check valve 80 is inserted within the valve housing 62, the retaining node 89 rests against the inner curved surface within the valve housing 62, while the barbs 88 protrude beyond the lower end of the valve housing 62, locking the check valve 80 into place. Thus, the retaining node 89 prevents the check valve 80 from moving downwards with respect to the valve housing 62; the barbs 88 prevent the check valve 80 from traveling upwards with respect to the valve housing 62.

The spring 90 is located around the check valve 80, such that the base of the spring 90 rests upon a plurality of ribs 68 situated in the lower portion of the valve housing 62. The top portion of the spring 90 is anchored underneath the top surface 72 of the piston 70. Before the tap assembly 20 is inserted within the valve housing 62, the spring 90 forces the piston 70 up against the check valve 80, thereby seating the check valve 80 within the valve seat 76.

As stated above, it is envisioned that the fluid container will be stored and transported to its intended place of use with the tap assembly 20 already attached to the fluid container. The tap assembly 20 may be used independently of the valve assembly 60 to dispense the fluid from the container. However, the preferred application is to use the tap assembly 20 in conjunction with the valve assembly 60. The valve assembly 60, preferably connected via its nozzle to a hose or dispensing apparatus, is mated with the corresponding tap assembly 20 by inserting the tap body 30 into the "U" shaped groove in the wall of the valve housing 62.

To ensure that the proper valve assembly 60 is used with the corresponding tap assembly 20, a mating system is employed. A safety key 92 is attached to or integrally molded with the crown 26 of tap assembly 20. As shown in FIGS. 5 and 7, the safety key 92 comprises a back section 94 having finger projections 96 that protrude out from the back section 94 towards the center of the tap handle crown 26. A plurality of parallel bars 98 are located towards the upper end of the valve housing 62 such that, for mating tap and valve assemblies 20 and 60, the spacing between each parallel bar 98 corresponds exactly to the spacing between the finger projections 96 on the safety key 92. This enables the operator to rotate the tap handle 22 after the tap assembly 20 is fully inserted into the valve assembly 60. Conversely, if an unmatched valve assembly 60 is used, the finger projections 96 on the safety key 92 would not align with the parallel bars 98 on the valve housing 62, and the tap handle 22 would not turn. The safety key configuration further serves to secure the tap assembly 20 to the valve assembly 60.

As the tap assembly 20 is inserted within the valve housing 62, the tap shaft 34 forces the piston 70,downwards against the spring 90, and unseats the check valve 80, thereby creating a fluid passageway around the check valve 80 and through the valve housing 62. The operator then rotates the tap handle 22 from the fully closed position to begin the flow of fluid from the container and through the valve assembly 60. When the container is empty, or when, for some other reason, the operator decides to remove the fluid container from the hose or other dispensing apparatus, the operator closes the tap assembly 20 and removes the tap assembly 20 from the valve assembly 60. Thus, the tap assembly 20 remains with the fluid container and the valve assembly 60 remains attached to the hose or other dispensing device. As the tap assembly 20 is removed from the valve assembly 60, the spring 90 forces the piston 70 upward to seat the piston 70 against the check valve 80 head portion 82. This effectively prevents residual fluid remaining in the hose or dispensing apparatus from flowing out of through the disconnected valve assembly 60. This back-flow prevention feature is particularly important when the fluid being dispensed is either toxic or hazardous to the operator or the environment.

Figure 8:
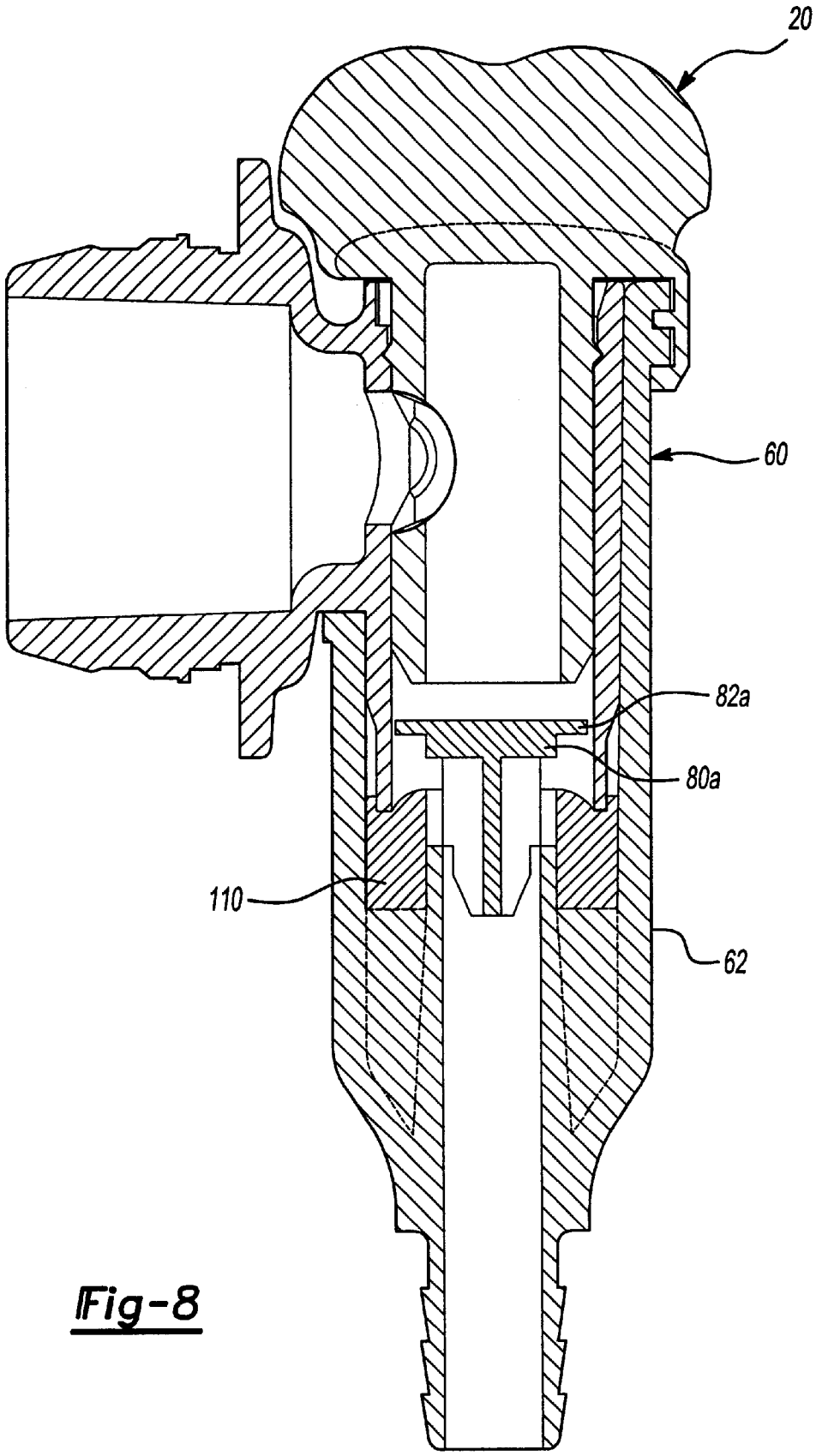
FIG. 8 is a cross-sectional view of an alternate embodiment of the tap and valve assembly, in which the piston and spring assembly is replaced with a resilient foam material.

In another embodiment of the invention, as illustrated in FIG. 8, a highly resilient foam material 110 replaces the piston/spring configuration. The foam material 110 is readily inserted during the assembly of the valve housing 62. As the tap assembly 20 is inserted into the valve housing 62, the foam material 110 deforms downwards, away from the head portion 82*a* of check valve 80*a*, thereby creating a fluid passageway around the check valve 80*a* and through the valve assembly 60. As the tap assembly 20 is removed, the resilient foam material 110 expands to its original shape and location around the head portion 82*a* of the check valve 80*a*. This prevents any back-flow of fluid through the valve assembly 60.

Figure 9:
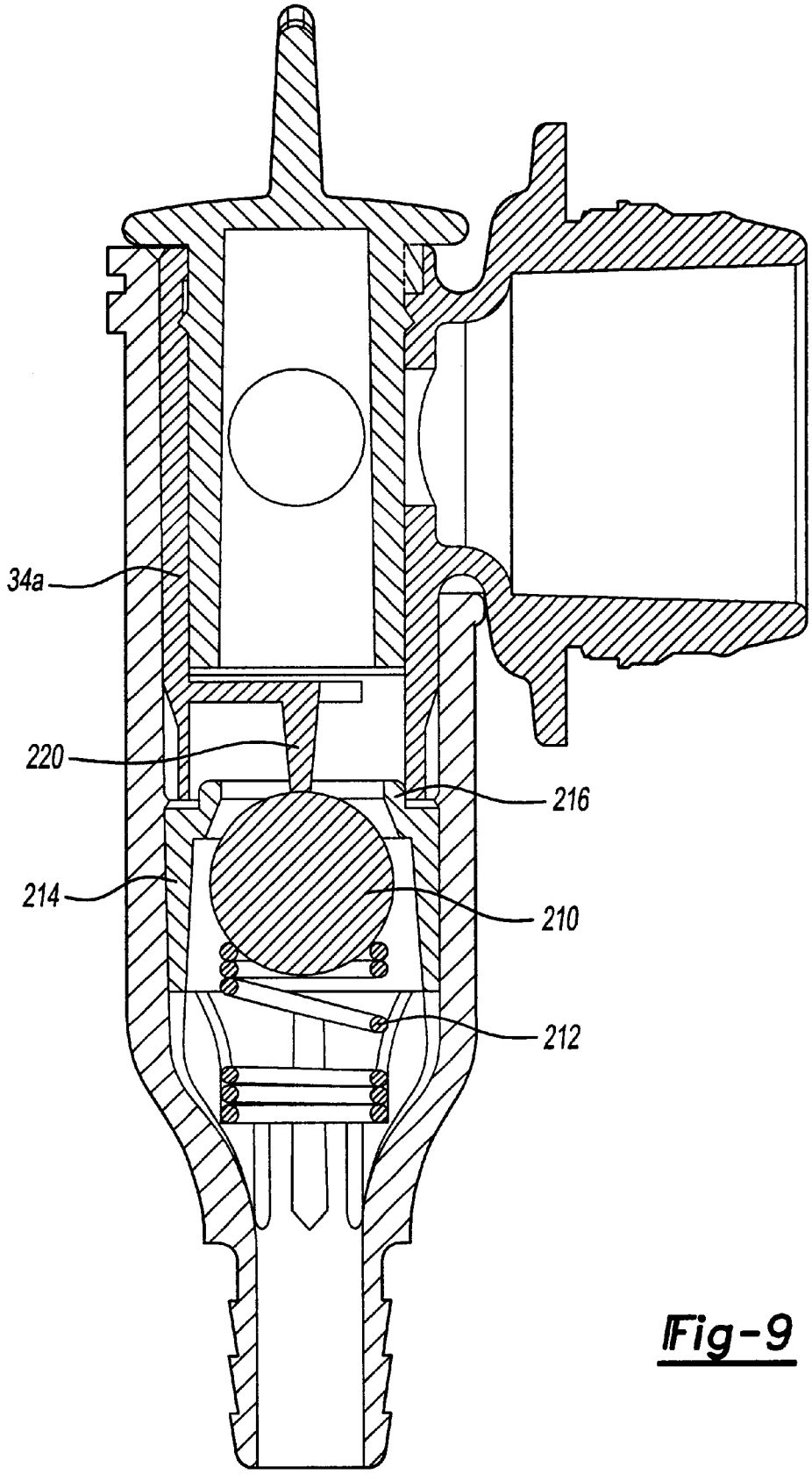
FIG. 9 is a cross-sectional view of another embodiment of the invention illustrating a ball and seat valve mechanism.

In yet another embodiment of the invention, as illustrated by FIG. 9, a different valve mechanism is used. In this embodiment, a ball and spring arrangement is used as the valve element. As shown in FIG. 9, a ball 210 rests upon a coil spring 212. The coil spring 212 is anchored between the valve housing 62 and the ball 210. The spring 212 seats the ball 210 against the ball seat 216 of retainer 214. As the tap assembly 20 is inserted within the valve assembly 60, a plunger 220 attached to the tap shaft 34*a* depresses the ball 210 downwards, thereby unseating the ball 210 from the ball seat 216. When the tap assembly 20 is removed, the plunger 220 is withdrawn and the spring 212 pushes the ball 210 upwards to once again seat the ball 210 against the ball seat 216. This prevents any back-flow of fluid through the valve assembly 60.

The foregoing detailed description has been given to facilitate understanding the invention only and no unnecessary limitations should be understood therefrom as some modifications will be obvious to those skilled in the art without departing from the scope and spirit of the appended claims.

What is claimed is:

1. A tap assembly for selectively storing or dispensing fluid from a fluid container, the tap assembly comprising:

a tap body having an attachment receptacle for removably securing the tap body to the fluid container, and an integral shaft portion having an upper section and an inner and outer surface, the shaft portion being connected to and oriented perpendicular to the attachment receptacle such that a fluid passageway is established between the attachment receptacle and the shaft;

a tap handle having a top portion and a stem portion, the stem portion having cylindrical walls with an orifice in the wall, the tap handle being rotatable within the shaft between a first open position in which the orifice in the stem portion of the tap handle is aligned with the fluid passageway of the tap body, and a second closed position where the cylindrical walls of the stem portion close off the fluid passageway of the tap body, and wherein;

the upper section of the shaft portion has a grooved track running along the inner surface thereof, and wherein a vertical rib is attached to the outer surface of the stem portion of the tap handle, such that as the tap handle is inserted within the shaft portion, the vertical rib seats within the grooved track and moves along the grooved track as the tap handle is rotated.

2. The tap assembly as described in claim 1, further comprising:

a plurality of ridges situated at intervals along the grooved track, so as to give a tactile indication of the progress of the vertical rib along the grooved track.

3. The tap assembly as described in claim 1, further comprising:

an annular bead located around the outer surface of the stem portion of the tap handle at a location above the orifice in the wall of the stem portion; and a corresponding annular groove located on the inner surface of the shaft portion, such that when the tap handle is inserted within the tap body, the annular bead seats within the annular groove, thereby forming a pressure fit between the tap body and the tap handle.

4. The tap assembly as described in claim 1, further comprising:

a locking tab attached to the top portion of the tap handle; and a securing means situated along the wall of the shaft portion of the tap body, such that, when the tap handle is inserted within the tap body, the locking tab is inserted into the securing means, thereby preventing the tap handle from being rotated away from the closed position until the locking tab is removed.

5. The tap assembly as described in claim 4, wherein the locking tab is attached to the tap handle by a plurality of frangible elements.

6. A tap and valve assembly for selectively storing or dispensing fluid from a fluid container, comprising:

a tap body having an attachment receptacle for removably securing the tap body to the fluid container, and an integral cylindrical shaft portion connected to the attachment receptacle such that a fluid passageway is established between the attachment receptacle and the shaft portion;

a tap handle having a top portion and a stem portion, the stem portion having cylindrical walls with an orifice in the wall, the tap handle being rotatable within the shaft portion between a first open position in which the orifice in the stem portion of the tap handle is aligned with the fluid passageway of the tap body, and a second closed position in which the cylindrical walls of the stem portion close off the fluid passageway of the tap body; and a valve body having a cylindrical body portion and a tapered nose section;

a piston sized to fit sealingly within the body portion of the valve body, the piston having a top surface and a downwardly depending skirt, the top surface of the piston having a centrally located opening therein;

a check valve placed within the opening in the piston, the check valve having a valve head sized to seat within the opening in the top surface of the piston, a body section, and a plurality of legs extending downwards from the body section, the check valve being anchored within the valve body to prevent any vertical movement of the check valve within the valve body; and a coil spring placed around the check valve and being anchored between the top surface of the piston and the tapered nose section of the valve body, such that, as the tap body is inserted within the valve body, the shaft displaces the piston downward against the force of the spring and away from the head of the check valve, thereby unseating the check valve.

7. The tap and valve assembly as described in claim 6, wherein the shaft portion of the tap body has an upper section which extends above the attachment point with the attachment receptacle, and further comprising:

a grooved track situated along the upper section of the shaft portion; and a vertical rib attached to the outer surface of the stem portion of the tap handle, such that as the tap handle is inserted within the shaft portion, the vertical rib seats within the grooved track and moves along the grooved track as the tap handle is rotated.

8. The tap and valve assembly as described in claim 7, further comprising:

a plurality of ridges situated at intervals along the grooved track, so as to give a tactile indication of the progress of the vertical rib along the grooved track.

9. The tap and valve assembly as described in claim 6, further comprising:

an annular bead located around the outer surface of the stem portion of the tap handle at a location above the orifice in the wall of the stem portion; and a corresponding annular groove located on the inner surface of the shaft portion, such that when the tap handle is inserted within the tap body, the annular bead seats within the annular groove, thereby forming a pressure fit between the tap body and the tap handle.

10. The tap and valve assembly as described in claim 6, further comprising:

a locking tab attached to the top portion of the tap handle; and a securing means attached to the shaft portion of the tap body, such that, when the tap handle is inserted within the tap body, the locking tab is anchored within the securing means, thereby preventing the tap handle from being rotated away from the closed position until the locking tab is removed.

11. The tap and valve assembly as described in claim 6, wherein the body portion of the valve body has a "U" shaped cutout for receiving the tap body.

12. The tap and valve assembly as described in claim 6, wherein the body section of the check valve is cruciform shaped, and wherein the check valve legs are resilient and displace inwards to facilitate inserting the check valve through the nose section of the valve body.

13. The tap and valve assembly as described in claim 12, further comprising:

an upward and outward protruding barb at the tip of each of the check valve legs; and a retaining node located along the body section of the check valve, such that as the check valve is placed within the valve body, the barbs extend beyond the nose section of the valve body preventing the check valve from moving upwards into the valve body, while the retaining node rests against the base of the body portion of the valve body preventing the check valve from moving downwards through the nose section of the valve body, thereby anchoring the check valve within the valve body.

14. The tap and valve assembly as described in claim 6, further comprising:

a key attached to the top portion of the tap handle, the key comprising a downwardly-extending back portion and a plurality of finger projections that protrude inwards towards the tap handle; and a plurality of parallel bars placed on the body portion of the valve body, the parallel bars being spaced apart on the body portion so as to correspond to the spacing between the finger projections of the key, such that, as the tap handle is fully inserted within the valve body, the finger projections mate with the parallel bars, thereby allowing the tap handle to rotate within the tap body.

15. A tap and valve assembly for selectively storing or dispensing fluid from a fluid container, comprising:

a tap body having an attachment receptacle for removably securing the tap body to the fluid container, and an integral cylindrical shaft portion connected to the attachment receptacle such that a fluid passageway is established between the attachment receptacle and the shaft;

a tap handle having a top portion and a stem portion, the stem portion having cylindrical walls with an orifice in the wall, the tap handle being rotatable within the shaft between a first open position in which the orifice in the stem portion of the tap handle is aligned with the fluid passageway of the tap body, and a second closed position where the cylindrical walls of the stem portion close off the fluid passageway of the tap body; and a valve body having a cylindrical body portion and a tapered nose section;

a resilient foam material inserted within the body portion of the valve body, the foam material having a centrally located opening therethrough; and a check valve placed within the opening in the piston, the check valve having a valve head sized to seat within the opening in the foam material, a body section, and a plurality of legs extending downwards from the body section, the check valve being anchored within the valve body to prevent any vertical movement of the check valve within the valve body;

such that, as the tap body is inserted within the valve body, the shaft displaces the foam material downwards, unseating the head of the check valve.

16. A tap assembly for selectively storing or dispensing fluid from a fluid container, the tap assembly comprising:

a tap body having an attachment receptacle for securing the tap body to the fluid container, and an integral shaft portion connected to the attachment receptacle such that a fluid passageway is established between the attachment receptacle and the shaft;

a tap handle having a top portion and a stem portion, the stem portion having cylindrical walls with an orifice in the wall, the tap handle being insertable into the tap body, and rotatable within the shaft between a first open position in which the orifice in the stem portion of the tap handle is aligned with the fluid passageway of the tap body, and a second closed position where the cylindrical walls of the stem portion close off the fluid passageway of the tap body;

a locking tab attached to the top portion of the tap handle, and extending downwards therefrom; and securing brackets for receiving the locking tab as the top handle is inserted into the tap body.

17. The tap assembly as described in claim 16, wherein the locking tab is attached to the top portion of the tap handle by a plurality of frangible bridges, such that, when the locking tab is inserted within the securing brackets the top handle is rotated by first breaking the frangible bridges and separating the locking tab from the tap handle.

18. The tap assembly as described in claim 16, and further comprising a key attached to the top portion of the tap handle, the key comprising a downwardly-extending back portion and a plurality of finger projections that protrude inwards towards the tap handle, for engagement with a fluid receptacle.

19. A tap and valve assembly for selectively storing or dispensing fluid from a fluid container, comprising:

a tap body having an attachment receptacle for securing the tap body to the fluid container, and an integral cylindrical shaft portion connected to the attachment receptacle such that a fluid passageway is established between the attachment receptacle and the shaft portion;

a tap handle having a top portion and a stem portion, the stem portion having cylindrical walls with an orifice in the wall, the tap handle being rotatable within the shaft portion between a first open position in which the orifice in the stem portion of the tap handle is aligned with the fluid passageway of the tap body, and a second closed position in which the cylindrical walls of the stem portion close off the fluid passageway of the tap body;

a locking tab attached to the top portion of the tap handle, and extending downwards therefrom;

securing brackets attached to the shaft portion of the tap body, for receiving the locking tab as the top handle is inserted into the tap body;

a valve body having a cylindrical body portion and a tapered nose section, the valve body being sized to receive the shaft portion of the tap body; and a valve mechanism housed within the valve body, and whereby inserting the shaft portion of the tap body opens the valve mechanism and allows fluid to pass through the valve body, and removing the shaft portion closes the valve mechanism.

20. The tap and valve assembly as described in claim 19, wherein the locking tab is attached to the top portion of the tap handle by a plurality of frangible bridges, such that, when the locking tab is inserted within the securing brackets the top handle is rotated by first breaking the frangible bridges and separating the locking tab from the tap handle.

21. The tap and valve assembly as described in claim 19, further comprising:

a key attached to the top portion of the tap handle, the key comprising a downwardly-extending back portion and a plurality of finger projections that protrude inwards towards the tap handle; and a plurality of parallel bars placed on the body portion of the valve body, the parallel bars being spaced apart on the body portion so as to correspond to the spacing between the finger projections of the key, such that, as the tap handle is fully inserted within the valve body, the finger projections mate with the parallel bars, thereby allowing the tap handle to rotate within the tap body.

22. The tap and valve assembly as described in claim 19, wherein the valve mechanism comprises:

a plunger attached to the shaft portion of the tap body;

a ball seat sized to fit sealingly within the body portion of the valve body, the ball seat having a top surface and a downwardly depending skirt, the top surface having a centrally located opening therein;

a ball sized to seat within the opening in the top surface of the ball seat; and a coil spring anchored between the ball and the base of the body portion of the valve body, such that, as the tap body is inserted within the valve body, the plunger displaces the ball downward against the force of the spring and away from the ball seat, thereby allowing fluid to pass through the valve body.

* * * * *